US008776395B2

(12) United States Patent
Tatar

(10) Patent No.: US 8,776,395 B2
(45) Date of Patent: Jul. 15, 2014

(54) WASHER/DRYER

(75) Inventor: Hakan Tatar, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 0 days.

(21) Appl. No.: 12/447,897

(22) PCT Filed: Oct. 30, 2007

(86) PCT No.: PCT/EP2007/061638

§ 371 (c)(1),
(2), (4) Date: Apr. 29, 2009

(87) PCT Pub. No.: WO2008/052976

PCT Pub. Date: May 8, 2008

(65) Prior Publication Data

US 2010/0050463 A1 Mar. 4, 2010

(30) Foreign Application Priority Data

Oct. 31, 2006 (TR) ..... a 2006/06052

(51) Int. Cl.
*F26B 25/06* (2006.01)
*D06F 58/18* (2006.01)

(52) U.S. Cl.
USPC ..... 34/603; 34/242; 68/196

(58) Field of Classification Search
USPC ..... 34/201, 417, 437, 442, 499, 63, 87, 88, 34/90, 103, 108, 109, 110, 128, 596, 603, 34/202, 236, 242; 68/196
See application file for complete search history.

(56) References Cited

U.S. PATENT DOCUMENTS

| | | | | |
|---|---|---|---|---|
| 3,696,521 | A | 10/1972 | Hubbard | |
| 4,091,548 | A | 5/1978 | Daily | |
| 6,301,733 | B1 | 10/2001 | Dawson et al. | |
| 2003/0010736 | A1 | 1/2003 | Hope | |
| 2006/0086151 | A1 | 4/2006 | Kim et al. | |
| 2006/0086155 | A1 * | 4/2006 | Kim et al. | 68/196 |

FOREIGN PATENT DOCUMENTS

| | | | |
|---|---|---|---|
| DE | 20119102 | U1 | 4/2004 |
| EP | 1652992 | A | 5/2006 |
| FR | 2171084 | A1 | 9/1973 |
| WO | 00/39383 | A | 7/2000 |

* cited by examiner

*Primary Examiner* — Jiping Lu
(74) *Attorney, Agent, or Firm* — Venable, Campillo, Logan & Meaney, PC

(57) ABSTRACT

A washer or dryer including a body with a loading port covered by a door having a convex transparent face that extends from the loading port inwards towards the interior of the body; and a detachable convex carrier having a depth and diameter greater than the convex transparent face that is stored on the convex transparent face that extends from the loading port inwards towards the interior of the body.

14 Claims, 2 Drawing Sheets

WASHER/DRYER

Figure 1:
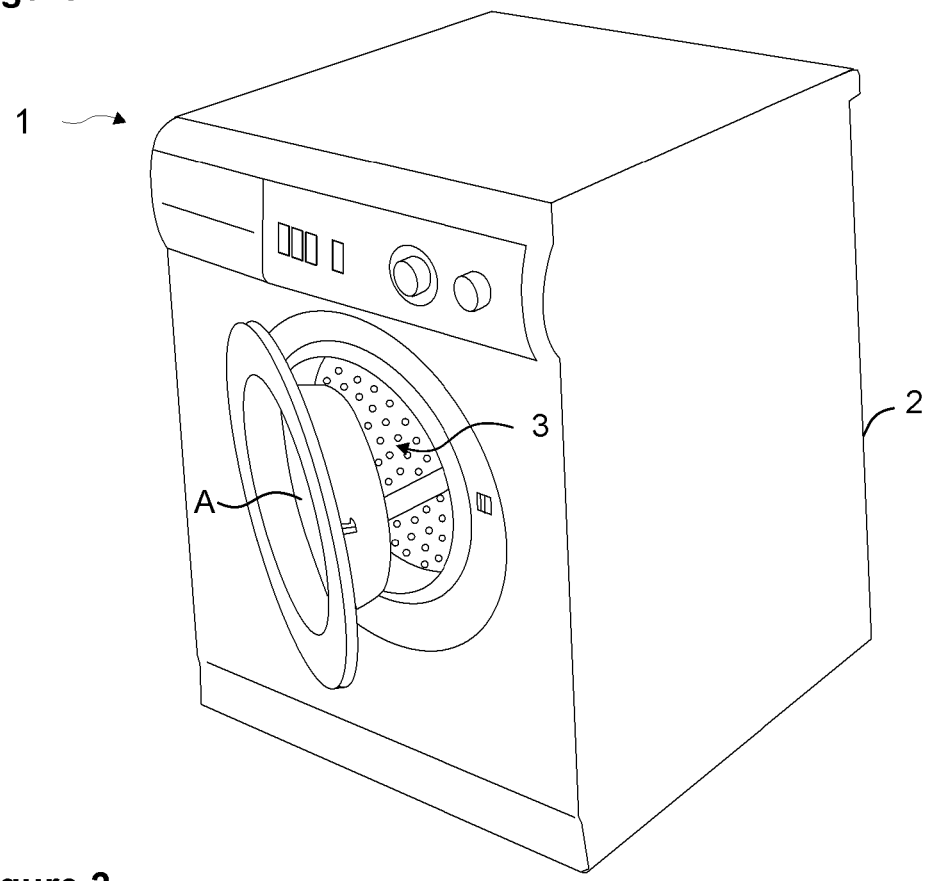

This application claims priority under 35 U.S.C. §119 to International Patent Application no. PCT/EP2007/061638, filed Oct. 30, 2007, the disclosure of which is incorporated herein by reference.

BACKGROUND

The present invention relates to a washer-dryer providing the washed laundry to be easily carried and stored after taking them thereout.

In washer or dryers, particularly in laundry washers/dryers, elements such as a basket, washtub etc. are required for taking the laundry out of the machine and carrying to put away after the washing process is completed. However, these additional elements occupy space when not used and also gather dust making the clean laundry placed therein get dirty in the next usage.

Various implementations have been designed in the technique for solving these problems. In one of the state of the art applications, the U.S. Pat. No. 6,301,733, a laundry net is described. With this embodiment, it is intended to place the laundry in the net before washing and taking out of the machine after washing in the same net to take to the place for drying.

Another state of the art application is the subject matter of the invention in the French patent no. FR2171084. In this application, a carrier is explained that can be stored in folded form inside the outer door of the washing machine and opened to store and carry the clothes when laundry is to be taken out of the machine.

In another state of the art application, the U.S. Pat. No. 4,091,548, a laundry basket is described that is mounted on the front door of the dryer such that it can be pivotally opened. It is intended to load the laundry into the machine by placing in this basket and afterwards to unload from this basket. Thus, the amount of laundry to be loaded in the machine is limited by the volume of the said basket.

SUMMARY OF THE INVENTION

The object of the present invention is to design a washer or dryer whereby the processes of loading, unloading the laundry and carrying the unloaded laundry to another place can be carried out easily.

The washer or dryer designed to fulfill the object of the present invention is explicated in the claims.

The washer or dryer of the present invention comprises a body, a loading port disposed on the body allowing the laundry to be placed into the washer or dryer, a door covering the loading port in a leak-proof manner, having a convex configuration, extending from the loading port towards the inside of the body and a carrier that can be placed in the convex part of the door. The carrier can be selectively detached from the door and used for unloading the laundry from the washer or dryer and carrying by placing the laundry therein.

In an embodiment of the present invention, the carrier is fitted inside the convex part of the door such that it will stay outside the washer or dryer when the door is closed. In this embodiment, it is possible to access the carrier even when the door is closed.

In another embodiment of the present invention, the carrier is fitted on the outside of the convex part of the door such that it will stay inside the washer or dryer when the door is closed. In this embodiment of the present invention, the carrier is washed together with the laundry in each washing maintaining hygienic usage. Moreover, more laundry can be carried since the depth and width of the carrier fitted on the outside of the convex part is larger.

In an embodiment of the present invention, the carrier comprises at least one handle for allowing the user to grasp the carrier for detaching easily from the door and carrying.

In the preferred embodiment of the present invention, the carrier is transparent. Thus, even when emplaced inside the door, the user can view the interior of the machine and if present, the washed laundry.

BRIEF DESCRIPTIONS OF THE DRAWINGS

The washer or dryer designed to fulfill the object of the present invention is illustrated in the attached figures, where:

FIG. 1—is the perspective view of an embodiment of the present invention.

Figure 2:
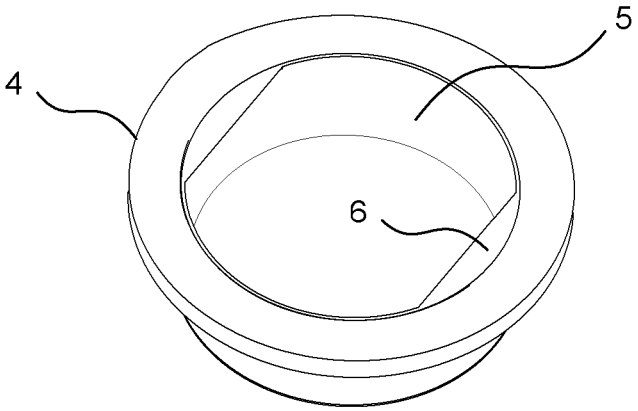

FIG. 2—is the schematic view of an embodiment of the present invention when the carrier is fitted on the door.

Figure 3:
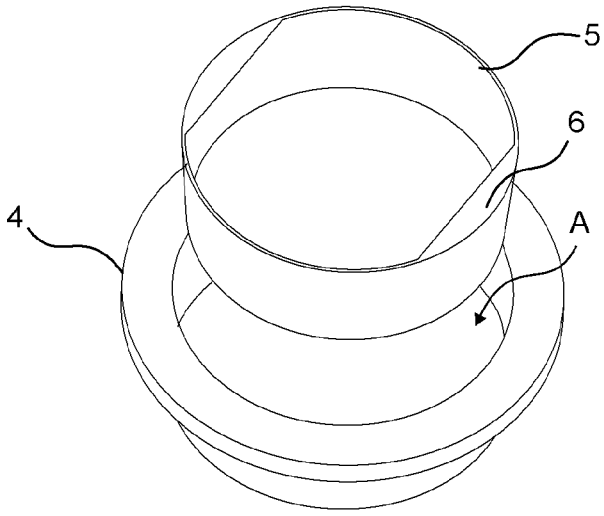

FIG. 3—is the schematic view of an embodiment of the present invention, wherein the carrier has a depth and diameter smaller than the convex part (A) of the door (4).

Figure 4:
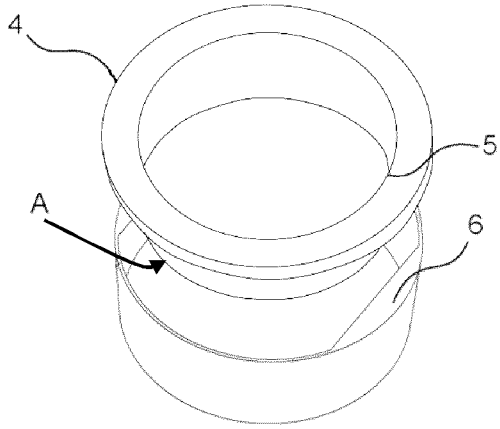

FIG. 4—is the schematic view of another embodiment of the present invention, wherein the carrier has a depth and diameter greater than the convex part (A) of the door (4).

DETAILED DESCRIPTION OF THE INVENTION

The elements illustrated in the figures are numbered as follows:

1. Washer or dryer
2. Body
3. Loading port
4. Door
5. Carrier
6. Handle The washer or dryer (1) of the present invention comprises a body (2), a loading port (3) disposed on the body (2) allowing to place the laundry therein, a door (4) mounted on the body (2) such that the loading port (3) is covered in openable and closable manner, having a convex configuration, extending from the loading port (3) towards the inside of the body (2) and at least one carrier (5) stored by fitting on the convex face of the door (4), detached when desired for using in unloading and carrying the laundry (FIG. 1).

In an embodiment of the present invention, the carrier (5), when not in use, is fitted inside the convex part (A) of the door (4) that faces the outside when closed. The carrier (5), having a depth and diameter smaller than the convex part (A) of the door (4) allowing to be placed inside the door (4), is shaped like a washtub wherein laundry can be placed, and can be detached from the door (4) when desired to be used in carrying the laundry. In this embodiment, the carrier (5) can also be accessed without opening the door (4).

In another alternative of this embodiment, the carrier (5), when not in use, is fitted on the outside of the convex part (A) of the door (4) that faces inwards when closed. The carrier (5) having a depth and diameter greater than the convex part (A) of the door (4) thus allowing to be placed outside of the door (4), is again shaped like a washtub wherein the laundry can be placed, and can be detached from the door (4) when desired to be used in carrying the laundry. In this embodiment, keeping the carrier (5) inside the washer or dryer (1) when not in use, allows thereof to be cleaned in each washing thus maintaining hygienic usage. Furthermore, more laundry can be carried since the depth and width of the carrier (5) fitted on the outside of the convex part (A) of the door (4) is larger.

In an embodiment of the present invention, the door (4) and the carrier (5) are configured frustonically.

In an embodiment of the present invention, the carrier (5) comprises at least one handle (6) that allows the user to grasp the carrier (5) easily for detaching from the door (4) and carrying (FIG. 2).

In an embodiment of the present invention, the carrier (5) is produced of a transparent material. Thus, when the carrier (5) is fitted on the door (4), viewing the interior of the washer or dryer (1) is not prevented and if present, the washed laundry inside the washer or dryer (1) and the washing process can be monitored.

In another embodiment of the present invention, the carrier (5) is produced of a material having a reflecting/insulating effect, such as Teflon. Consequently, when the carrier (5) is fitted on the door (4), the rate of the radiation reaching outside of the washing tub is reduced, for example UV radiation, which is created in the washer or dryer (1) for performing the washing and/or drying processes but not desired to be emitted outside. Moreover, the efficiency of the washer or dryer (1) is increased by providing heat insulation.

With the washer or dryer (1) of the present invention, the requirement for additional elements such as basket, washtub etc. for storing and carrying the laundry after taking out of the washer or dryer (1) is not necessary anymore. The carrier (5), stored by fitting on the door (4) when not used, does not occupy space, and can be used for unloading and carrying the laundry by detaching and placing the laundry therein.

The invention claimed is:

1. A washer or dryer comprising: a body;

a loading port disposed on the body allowing to place the laundry into the washer or dryer;

a door, mounted on the body such that the loading port is covered in an openable and closable manner, and having a convex part that extends from the loading port towards the interior of the body; and a detachable convex carrier made of a material that reduces radiation reaching outside the washer or dryer, having a diameter and depth greater than the convex part, and stored by fitting on the convex part of the door that extends from the loading port towards the interior of the body such that the detachable convex carrier is inside the washer or dryer, and can be detached when desired for using in unloading and carrying the laundry.

2. The washer or dryer in claim 1 wherein, the convex part and the detachable convex carrier both have a frustoconic configuration.

3. The washer or dryer in claim 2 wherein, the detachable convex carrier comprises a transparent material.

4. The washer or dryer in claim 3 wherein, the material that reduces radiation reaching outside the washer or dryer has a reflecting/insulating effect.

5. The washer or dryer in claim 3 wherein, the material that reduces radiation reaching outside the washer or dryer has consists of teflon.

6. The washer or dryer in claim 3 wherein, the detachable convex carrier includes a handle for easily detaching from the door.

7. A washer or dryer comprising: a body;

a loading port disposed on the body allowing to place the laundry into the washer or dryer;

a door having a mount for mounting the door the body at a side nearest to the loading port such that the loading port is covered in an openable and closable horizontal manner, and having a convex part that extends from the loading port towards the interior of the body; and a detachable convex carrier, having a diameter and depth greater than the convex part, and stored by fitting on the convex part of the door that extends from the loading port towards the interior of the body such that the detachable convex carrier is inside the washer or dryer, and can be detached when desired for using in unloading and carrying the laundry wherein the convex part and the detachable convex carrier both have a frustoconic configuration and wherein the detachable convex carrier comprises a transparent material and wherein the detachable convex carrier consists of Teflon.

8. The washer or dryer in claim 7 wherein, the detachable convex carrier includes a handle for easily detaching from the door.

9. A washer or dryer comprising: a body;

a loading port disposed on the body allowing to place the laundry into the washer or dryer;

a door having a mount for mounting the door on the body in a horizontal manner such that the loading port is covered in an openable and closable, and having a convex part that extends from the loading port towards the interior of the body; and a detachable convex carrier made of a material that reduces radiation reaching outside the washer or dryer and having a diameter and depth greater than the convex part, and stored by fitting on the convex part of the door that extends from the loading port towards the interior of the body such that the detachable convex carrier is inside the washer or dryer, and can be detached when desired for using in unloading and carrying the laundry.

10. The washer or dryer in claim 9 wherein, the convex part and the detachable convex carrier both have a frustoconic configuration and minimizing space occupied by the detachable convex carrier within the body.

11. The washer or dryer in claim 10 wherein, the detachable convex carrier comprises a transparent material.

12. The washer or dryer in claim 11 wherein, the detachable convex carrier consists of a reflective material.

13. The washer or dryer in claim 11 wherein, the detachable convex carrier consists of an insulating material.

14. The washer or dryer in claim 11 wherein, the detachable convex carrier includes a handle for easily detaching from the door.

* * * * *